United States Patent [19]

Nishigami

[11] 4,055,128

[45] Oct. 25, 1977

[54] ORNAMENTAL STITCH SEWING MACHINE

[75] Inventor: Teiichi Nishigami, Osaka, Japan

[73] Assignee: Maruzen Sewing Machine Co., Ltd., Moriguchi, Japan

[21] Appl. No.: 660,367

[22] Filed: Feb. 23, 1976

[30] Foreign Application Priority Data

Feb. 27, 1975 Japan ..... 50-27272

[51] Int. Cl.[2] ..... D05B 3/02

[52] U.S. Cl. ..... 112/158 A

[58] Field of Search ..... 112/158 A, 158 D, 158 R, 112/158 B, 158 C; 74/567, 568 R, 568 M

[56] References Cited

U.S. PATENT DOCUMENTS

| | | | |
|---|---|---|---|
| 2,983,240 | 5/1961 | Engel | 112/158 B |
| 3,090,334 | 5/1963 | Hayashi et al. | 112/158 B |
| 3,766,871 | 10/1973 | Mastuda et al. | 112/158 A X |

*Primary Examiner*—Werner H. Schroeder
*Assistant Examiner*—Peter Nerbun
*Attorney, Agent, or Firm*—Arnstein, Gluck, Weitzenfeld & Minow

[57] ABSTRACT

An ornamental stitch sewing machine has a drive shaft with a first cam mounted on the shaft for axial movement. The cam is tracked by a tracking element. A second cam is adapted to be removably mounted on the shaft in superposed relation to the first cam and when so mounted displaces the first cam so that it is rendered ineffective and the tracking element responds only to the second cam. Upon removal of the second cam the first cam is again rendered effective for tracking by the tracking element.

4 Claims, 5 Drawing Figures

ORNAMENTAL STITCH SEWING MACHINE

BACKGROUND OF THE INVENTION

Conventional ornamental stitch sewing machines utilize separate cams for respectively controlling lateral movement of the needle bar and the forward and reverse movements of the feed dog. A set of cams, whether of the drop-in type or of the built-in type, for controlling the movements of the needle bar, generally includes a more frequently used cam for producing an ordinary zig-zag stitch, as well as other less frequently used cams, for producing a variety of different stitch patterns. In the case of drop-in type cams, such cams conventionally are formed of molded plastic material in a double tier formation, with one cam controlling the movement of the needle bar and the other cam controlling the movement of the feed dog. Thus, each conventional drop-in cam actually comprises a pair of cams integral with each other so that both cams must be used in the machine simultaneously to obtain a particular stitch pattern. In such an arrangement a relatively large number of double cams are required to be made available in order to cover a particular range of stitch patterns. For example, if a cam (A) which controls the feed dog is combined with each one of different cams (B,C,D, and E), each of which controls the lateral movement of the needle bar, four such double cams are required to produce a particular range of stitch patterns. Thus, in the above example, cam A, which performs a particular function, is repeated four times, once in each of the four combinations.

In the case where a plurality of built-in cams is incorporated in a machine, a relatively complex cam selection mechanism is required to be used to effect shifting of the cam followers into registration with desired cams.

In accordance with my invention, I provide on a drive shaft a built-in feed cam for controlling the forward and reverse movements of the feed dog, such cam cooperating with a registering follower or tracking element, the movement of which may be modified by other conventional mechanism. Also, coaxially mounted on the shaft is a conventional zig-zag cam for controlling the lateral movement of the needle bar. The zig-zag cam is axially slidable on the shaft and normally is spring biased to register with a second cam tracking element operatively connected to the needle bar. The shaft is adapted to removably receive a third cam, one of a series of ornamental stitch cams. Said third cam when mounted on the shaft displaces the zig-zag cam but is itself disposed and maintained in registration with the second cam tracking element. In such condition, the zig-zag cam is rendered ineffective. However, upon removal of the third cam, the zig-zag cam automatically returns to its normal operative position in registration with the second tracking element. Thus, with my invention only a single cam is required to be replaced to vary the ornamental stitch pattern. The zig-zag cam which most frequently is used by an operator is merely temporarily displaced from operative position by the ornamental stitch cam and need not be removed from the shaft to accommodate the ornamental cam.

BRIEF DESCRIPTION OF A PREFERRED EMBODIMENT

Figure 1:
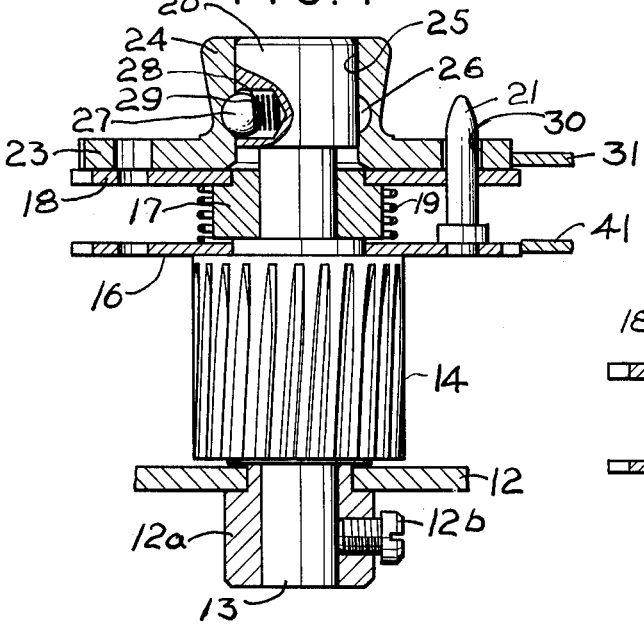
FIG. 1 is a fragmentary elevational view, partly in cross-section, of a sewing machine detail illustrating my invention and showing an ornamental stitch pattern cam mounted on the drive shaft.
Figure 2:
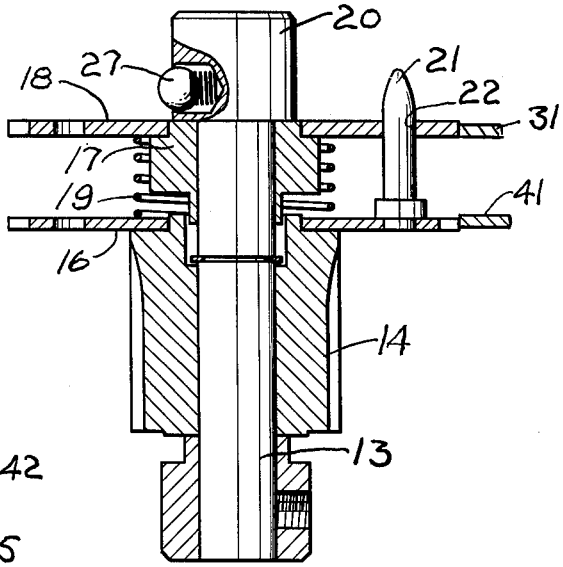
FIG. 2 is a similar view of the same detail showing the pattern cam removed and the zig-zag cam restored to operative position.

The mechanism illustrated in FIGS. 1 and 2, is contained within the overhanging arm of a sewing machine, not shown. A bracket 12 suitably attached to the interior of the arm includes a depending boss **12*a* which is provided with a bore to receive a shaft 13 which is secured within the bore as by a set screw 12*b*. Rotatably supported on the shaft 13 is a helical gear 14 which cooperates with a corresponding gear, not shown, fixed on the main driving shaft 15 extending lengthwise of the overhanging arm. A feed cam 16 is fixed to the upper end of the gear 14 for simultaneous rotation. A zig-zag cam 18 provided with a depending hub 17 is both rotatable and axially movable on shaft 13. The upper end of shaft 13 includes an enlarged head 20 provided with a transverse bore 28 in which is received a ball detent 27 biased outwardly by a spring 29. The ball detent 27 is partially confined within the bore 28 by a constriction at the mouth of the bore. The enlarged head 20 provides a lower shoulder for limiting the axial movement of the cam 18. A compression spring 19 circumposed about the hub 17 normally biases the cam 18 to its upper position, as illustrated in FIG. 2. A pin 21 fixed in a hole in the cam 16 extends upwardly through a hole 22 in cam 18. The pin 21 serves to lock the cams 16 and 18** for simultaneous rotation.

A decorative stitch cam 23, preferably molded of suitable plastic material, includes a handle or finger engaging portion 24. The cam 23 is provided with an axial bore 25 to fit snugly on the head 20. The bore 25 is provided with an annular recess 26 to receive the ball detent 27, as illustrated in FIG. 1. When the cam 24 is positioned on the head 20 the ball detent 27 enters the annular recess 26 and removably secures the cam 23 on the shaft 13. As will be noted, the pin 21 extends through an aperture 30 provided in the cam 23. Thus, the cam 23 is locked to the gear 14 for simultaneous rotation. The cam 23, of course, is readily removable from the head 20, since the ball detent 27 will be cammed inwardly of the bore 28 as the cam 23 is withdrawn from the head 20. The relation of the annular recess 26 to the ball detent 27 is such that when the ball detent 27 is in registration with the recess of cam 23, cam 18 is caused to be shifted to a lower position against the pressure of spring 19 and out of registration with cam tracking element 31.

As seen in FIGS. 1 and 2, a cam tracking element 41 is disposed in registration with the cam 16. The cam tracking element 41 is connected to conventional control means, hereinafter to be described, for mechanically and automatically imparting movement to the control means to vary the amplitude and direction of the feed movement of the feed dog of the machine, not shown. A second cam tracking element 31 is disposed in fixed spaced relation to the cam tracking element 41 and is connected to transmission mechanism, hereinafter to be described, for shifting the needle bar, not shown, sidewise in conformance with the contour of the cam. As will be noted in FIG. 2, when the cam 18 is in its uppermost position, it is disposed in registration with the cam tracking element 31. When the cam 18 is moved to its lower position, as illustrated in FIG. 1, the cam 18 is displaced from its position of registration with the tracking element 31 and thereby is rendered ineffective. However, the cam 23 now is in position to be tracked by the tracking element 31 so as to influence the movement of the needle bar.

It will be understood that the cam 23 is merely representative of a plurality of similar cams, each affording a different decorative stitch pattern which may be used interchangeably on shaft 13.

Figure 3:
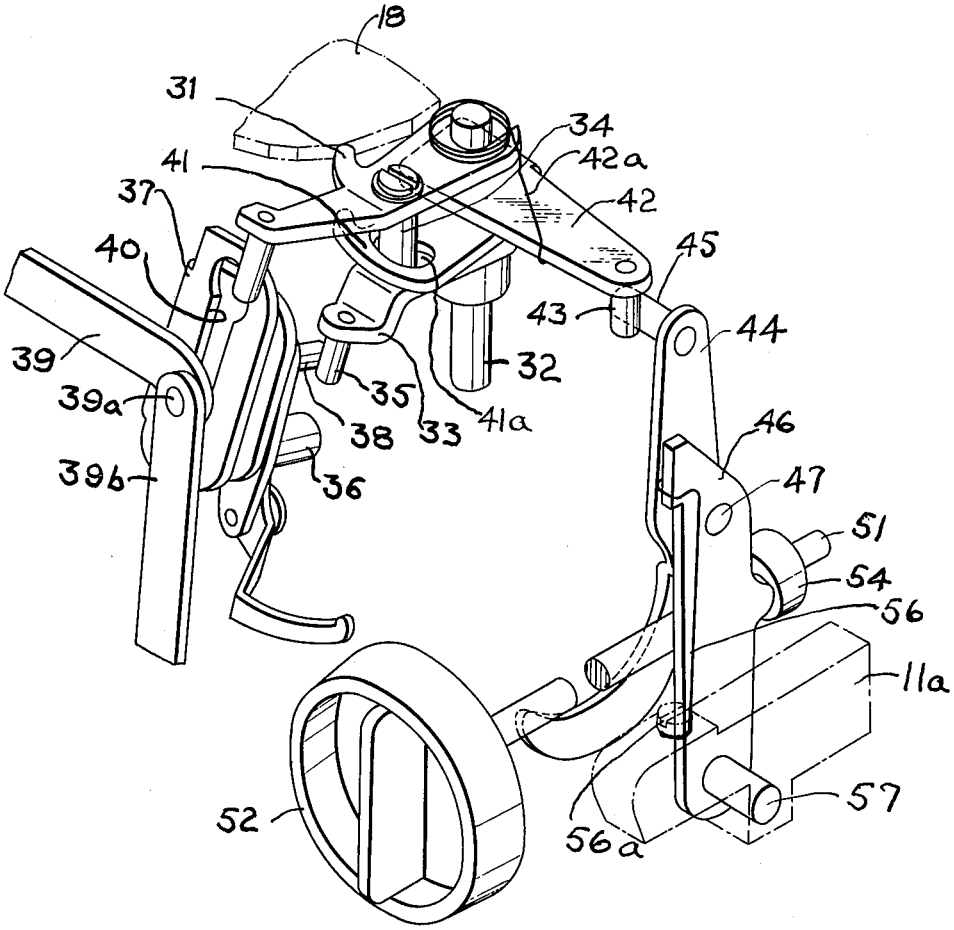
FIG. 3 is a fragmentary perspective view of another detail showing the cam tracking elements and associated mechanism.

As seen in FIG. 3 the cam tracking element 31 is pivotally supported on vertical shaft 32, the lower end of which is anchored in a boss, not shown, provided in the bracket 12. The tracking element 31 includes a lower generally parallel arm 33 which is mounted on the shaft 32 for rocking movement. The tracking element 31 and arm 33 are locked together for simultaneous rocking movement by a stud 34. The arm 33 is provided with a depending pin 35 which engages a pin 38 projecting from a guide block 37 pivotally supported on a shaft 36 fixed in the overhanging arm of the machine. The guide block 37 is provided with a slot 40 in which is received a headed pin **39*a* which pivotally connects pitman 39 and link 39*b*. Pitman 39 is connected to the needle bar of the machine, not shown, Rocking movement of the tracking element 31 about the axis of shaft 32 will effect rocking of the block 37 about axis of shaft 36 and impart movement to the pitman 39 to effect lateral rocking of the needle bar, not shown. Link 39*b* is connected to a control knob, not shown. Rotation of the knob effects movement of the pin 39*a* within the slot 40 and the position of the pin 39*a* relative to the slot 40 will determine the degree of lateral movement imparted by the pitman 39** to the needle bar.

The cam tracking element 41 is pivotally supported on vertical shaft 32 and includes an elongated slot **41*a* through which the pin 34 extends. The tracking element 41 includes an integral arm 42 disposed substantially at a right angle to the element 41 with the distal end of the arm 42 being provided with a depending pin 43. A torsion spring 42*a* has one end anchored in the shaft 32 and the other end in engagement with the arm 42 and normally biases arm 42 and cam tracking element 41 in a counter-clockwise direction, as viewed in FIG. 3, wherein the tracking element 41 is urged out of engagement with the cam 16**.

Figure 4:
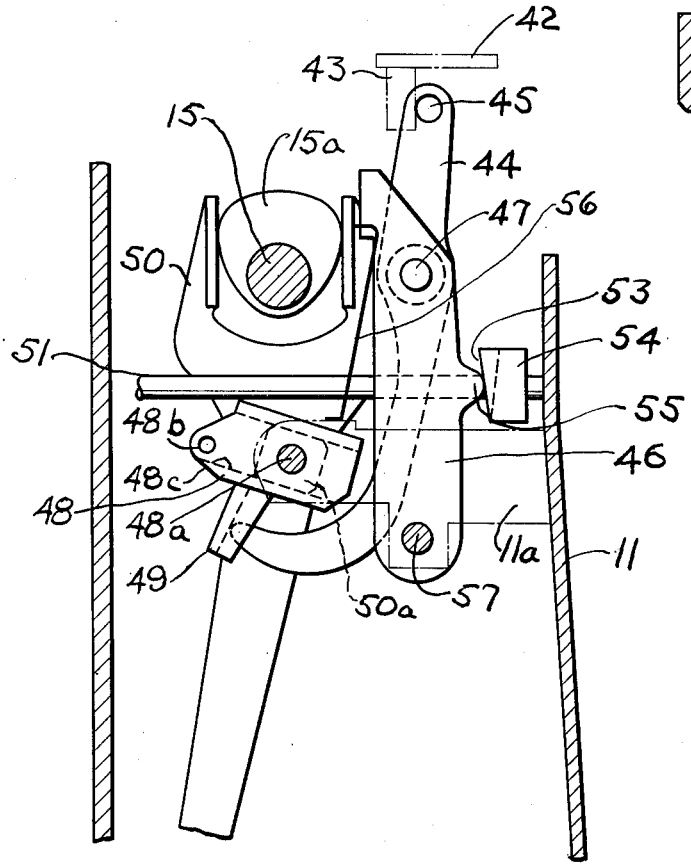
FIG. 4 is a fragmentary vertical cross-sectional view through the arm of the sewing machine showing some of the structural elements of FIG. 3 in relation to the main drive shaft of the machine, and FIGS. 5*a, b, c* and *d,* show representative examples of stitch patterns produced by decorative cams.

Referring to FIG. 4, the forward feed and stitch length are controlled by means of a conventional block member 48 pivoted on shaft **48*a* anchored in the bracket 11*a*. The block 48 is provided with a depending arm having a guide groove 49 in which is slidably received the lower end of a control member 44 which is pivotally supported by a pin 47 extending laterally from lever 46. The upper end of the control member 44 is provided with a laterally extending pin 45 which engages pin 43 depending from arm 42. Lever 46 is pivotally supported at its lower end on a pin 57 carried in the bracket 11*a*. The lever 46 is provided with a rearwardly directed extension 55 constituting a cam follower arranged to engage face cam 54 mounted on shaft 51 which is journalled in the frame 11, the shaft extending through the front wall of the housing and carrying a control knob 52. A spring 56 secured by screw 56*a* normally biases lever 46 in a direction so that the follower 55 is maintained in engagement with the face 53 of cam 54**.

The block 48 is biased in a counter-clockwise direction, as viewed in FIG. 4, by a spring, not shown, attached to a pin **48*b*. The block 48 is provided with a guide groove 48*c* in which is slidably received a slide element 50*a* pivotally secured to one side of pitman 50 having bifurcated jaws embracing a feed cam 15*a* fixed on shaft 15. Rotation of the control knob 52 effects rocking of the follower lever 46 through which control member 44 varies the inclination of the block member 48 to vary the vertical movement of pitman 50** which in turn actuates rock shafts, not shown, in a conventional manner. These rock shafts impart the usual feeding movements to a conventional feed dog, not shown.

As the tracking elements 31 and 41 are influenced by their respective cams 16 and 18 or 23, the pitmans 50 and 39 effect corresponding movement of the feed dog and needle bar, respectively, to cause variations in the lateral movement of the needle bar, as well as the stitch length or reverse feed, in accordance with contours of the cams. However, between the extreme positions the stitch design of a particular cam may be varied to obtain different stitch lengths, as well as lateral movements of the needle bar.

Link **39*b* is operatively connected to a control knob, not shown, which is operable to shift the headed pin 39*a* in slot 40 within the limits of the length of the slot to vary the position of the pin 39 in relation to the axis of shaft 36. Thus, the angular movement of the pin is varied to vary the amplitude of movement of the pitman 39** and the needle bar connected to it.

Figure 5:
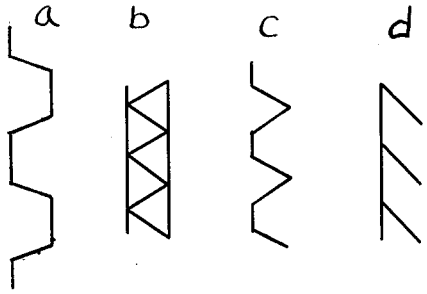

FIG. 5 illustrates examples of decorative stitching which may be effected with my invention. Stitch **5*a* is produced when a decorative cam 23 is utilized with the cam tracking element 41 disposed out of contact with the feed cam 16. In order to produce stitch 5*b* the same decorative cam as used in stitch 5*a* is utilized and cam 23 as well as feed cam 16** are engaged by their respective cam tracking elements.

In order to produce the stitch pattern **5*c* a different decorative cam 23 is employed and this cam is utilized by itself, with the feed cam 16 rendered ineffective. Stitch pattern 5*d* is produced by utilizing both the cam 23 for stitch 5*c*, as well as feed cam 16**.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In an ornamental stitch sewing machine comprising a frame, a feed dog, means for imparting movement to the feed dog, control means for varying the amplitude and the direction of the feed movements of the feed dog during sewing, means including a first cam and first cam tracking element for mechanically and automatically imparting movement to the control means to vary the amplitude and direction of the feed movement of the feed dog during sewing, a needle bar mounted for endwise reciprocation and for sidewise movement transversely of the direction of reciprocation, a second cam, a second cam tracking element, means biasing the first and second cam tracking elements against respective cams whereby the tracking elements will track and respond to said respective cams, transmission mechanism connecting the second cam tracking element with the needle bar for shifting the needle bar sidewise in conformance with the cam response of the second tracking element, means for rotating said cams in synchronism with the needle bar reciprocating movements, said first and second cams being coaxially mounted in spaced relation on a drive shaft for rotation therewith with said second cam being axially slidable, spring means normally biasing said second cam axially of said shaft into operative registration with said second tracking element, a third cam arranged to be received on said shaft in superposed relation to said second cam so as to displace said second cam from registration with said second tracking element, and means for releasably securing said third cam on said shaft in operative registration with said second tracking element whereby said second tracking element will respond only to said third cam with said second cam being rendered ineffective.

2. The invention as defined in claim 1 in which the releasable securing means comprises cooperating detent means in said drive shaft and said third cam.

3. The invention as defined in claim 1 in which the securing means comprises a spring biased ball in said drive shaft and the third cam includes an axial bore having an internal recess in which the ball is engaged.

4. The invention as defined in claim 1 wherein the second cam is automatically moved into registration with the second tracking element when the third cam is removed from the shaft.

* * * * *